US010570679B2

(12) United States Patent
Stoldt et al.

(10) Patent No.: US 10,570,679 B2
(45) Date of Patent: Feb. 25, 2020

(54) ELEVATOR WITH SECURING APPARATUS AND METHOD OF MOVING TUBULARS

(71) Applicant: FORUM US, INC., Houston, TX (US)

(72) Inventors: Frederik Stoldt, Hamburg (DE); Victor Manuel Eslava Moreno, Hamburg (DE); Robert Dugal, Spring, TX (US); Robert Arlen Holifield, Houston, TX (US)

(73) Assignee: FORUM US, INC., Houston, TX (US)

( * ) Notice: Subject to any disclaimer, the term of this patent is extended or adjusted under 35 U.S.C. 154(b) by 14 days.

(21) Appl. No.: 15/806,896

(22) Filed: Nov. 8, 2017

(65) Prior Publication Data

US 2019/0136648 A1 May 9, 2019

(51) Int. Cl.
*E21B 19/14* (2006.01)

(52) U.S. Cl.
CPC ..... *E21B 19/14* (2013.01)

(58) Field of Classification Search
CPC ..... E21B 19/06
See application file for complete search history.

(56) References Cited

U.S. PATENT DOCUMENTS

| | | | | |
|---|---|---|---|---|
| 1,624,799 | A | 4/1927 | Neilson | |
| 1,685,713 | A | 9/1928 | Moody | |
| 1,766,920 | A | 6/1930 | Moody | |
| 2,245,938 | A | 6/1941 | Ratigan | |
| 3,447,829 | A * | 6/1969 | Laszlo | E21B 19/14 294/91 |
| 4,269,554 | A | 5/1981 | Jackson | |
| 6,568,479 | B2 | 5/2003 | Mosing et al. | |
| 7,032,678 | B2 | 4/2006 | Mosing et al. | |
| 8,240,391 | B2 | 8/2012 | Bouligny, Jr. et al. | |
| 8,632,111 | B2 | 1/2014 | Krijnen et al. | |
| 9,227,819 | B2 | 1/2016 | Bouligny, Jr. et al. | |
| 2004/0040722 | A1 | 3/2004 | Mosing et al. | |
| 2006/0185854 | A1 | 8/2006 | Mosing et al. | |
| 2008/0136203 | A1 | 6/2008 | Krijnen et al. | |
| 2015/0027733 | A1 | 1/2015 | Sipos | |

FOREIGN PATENT DOCUMENTS

| | | |
|---|---|---|
| EP | 2180134 A1 | 4/2010 |
| WO | 2016022565 A1 | 2/2016 |

OTHER PUBLICATIONS

International Search Report and Written Opinion dated Feb. 19, 2019 for Application No. PCT/US2018/057107.

* cited by examiner

*Primary Examiner* — Giovanna C Wright
*Assistant Examiner* — Brandon M Duck
(74) *Attorney, Agent, or Firm* — Patterson & Sheridan, L.L.P.

(57) ABSTRACT

An elevator for moving a tubular having a tubular body and a joint section comprises an elevator body, a securing apparatus having a first blocking apparatus and a second blocking apparatus biased in a blocking position where a throat of the elevator is blocked, and an actuation apparatus coupled to the first blocking apparatus and the second blocking apparatus and adapted to manually move both the first blocking apparatus and the second blocking apparatus from the blocking position to a non-blocking position.

21 Claims, 10 Drawing Sheets

ELEVATOR WITH SECURING APPARATUS AND METHOD OF MOVING TUBULARS

BACKGROUND

Field

Embodiments described herein generally relate to elevators for supporting tubulars in the field of oil and gas production. More particularly, embodiments relate to an elevator having a securing apparatus and methods for moving tubulars that have been secured within the elevator.

Description of the Related Art

In the oil and gas industry, it is the usual practice to hoist tubulars, such as drill strings, production tubing, and other pipes, on rigs with various elevators of different capacities. Some elevators are designed for handling single tubular joints or a tubular string having two or three connected tubular joints. Such elevators may be referred to as single joint elevators, and typically are rated to handle up to ten to fifteen tons (10,000 to 15,000 kilograms). The single joint elevators may be needed to pick-up a single tubular joint or a tubular string that is in a vertical position, a horizontal position, or an inclined position, such as from a catwalk or a tubular storage area.

Single joint elevators typically have lifting members, sometimes referred to as ears, and the lifting members are connected to lifting slings. The lifting slings are connected to a crane used to move the elevator and the tubular secured in the elevator. For safety reasons, the tubular should be securely held within the elevator while raising, lowering, and transporting the tubular. Oftentimes the tubular has to be manually secured into the elevator by personnel on the rig, which if not done correctly increases the risk of injury.

Therefore, there is a continuous need for new and improved single joint elevators and methods for safely moving tubulars.

SUMMARY

Embodiments of the disclosure describe an apparatus and method for an elevator system that supports a tubular used for production of oil and gas.

In one embodiment, an elevator for moving a tubular having a tubular body and a joint section comprises an elevator body comprising a lower body section having a lower body surface; an upper body section having an upper body surface, wherein the upper body surface and the lower body surface define a central bore extending through the elevator body; and a first arm and a second arm defining a throat leading to the central bore and adapted to accept the tubular body as the tubular body moves into the central bore through the throat; a securing apparatus having a first blocking apparatus and a second blocking apparatus biased in a blocking position where the throat is blocked; and an actuation apparatus coupled to the first blocking apparatus and the second blocking apparatus and adapted to manually move both the first blocking apparatus and the second blocking apparatus from the blocking position to a non-blocking position.

In one embodiment, an elevator for moving a tubular having a tubular body and a joint section comprises an elevator body defining a central bore extending through the elevator body, the elevator body comprising a first arm and a second arm defining a throat leading to the central bore and adapted to accept the tubular body as the tubular body moves into the central bore; a securing apparatus having a first blocking apparatus and a second blocking apparatus, wherein the securing apparatus is adapted to move from the blocking position to a non-blocking position in response to the tubular body engaging the securing apparatus so as to exert a first force against the securing apparatus as the tubular body moves through the throat to the central bore, wherein the securing apparatus is adapted to move from the non-blocking position to the blocking position in response to a first biasing force and a second biasing force when the tubular body is moved into the central bore; and an actuation apparatus attached to the first blocking apparatus and the second blocking apparatus and adapted to manually move both the first blocking apparatus and the second blocking apparatus from the blocking position to the non-blocking position.

In one embodiment, a method of moving a tubular having a tubular body and a joint section with an elevator comprises positioning the elevator adjacent the tubular body, wherein the elevator comprises a lower body section having a lower body surface; an upper body section having an upper body surface, wherein the upper body surface and the lower body surface define a central bore extending through the elevator body; a first arm and a second arm defining a throat leading to the central bore and adapted to accept the tubular body as the tubular body moves to the central bore through the throat; a securing apparatus biased in a blocking position by a biasing force for securing the tubular in the elevator in a coupled position; and an actuation apparatus attached to the securing apparatus and adapted to manually move the securing apparatus from the blocking position to a non-blocking position; coupling the elevator to the tubular body by moving the elevator and the tubular into the coupled position; and moving the elevator to position the tubular in the coupled position into a suspended position, wherein the upper body surface has a contact arc greater than 180 degrees to support the joint section of the tubular when the elevator is coupled to the tubular with the tubular in the suspended position so as to trap the joint section of the tubular in the elevator.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only selected embodiments of this disclosure and are therefore not to be considered limiting of its scope, for the disclosure may admit to other equally effective embodiments.

To facilitate understanding, identical reference numerals have been used, wherever possible, to designate identical elements that are common to the Figures. Additionally, elements of one embodiment may be advantageously adapted for utilization in other embodiments described herein.

DETAILED DESCRIPTION

Figure 1:
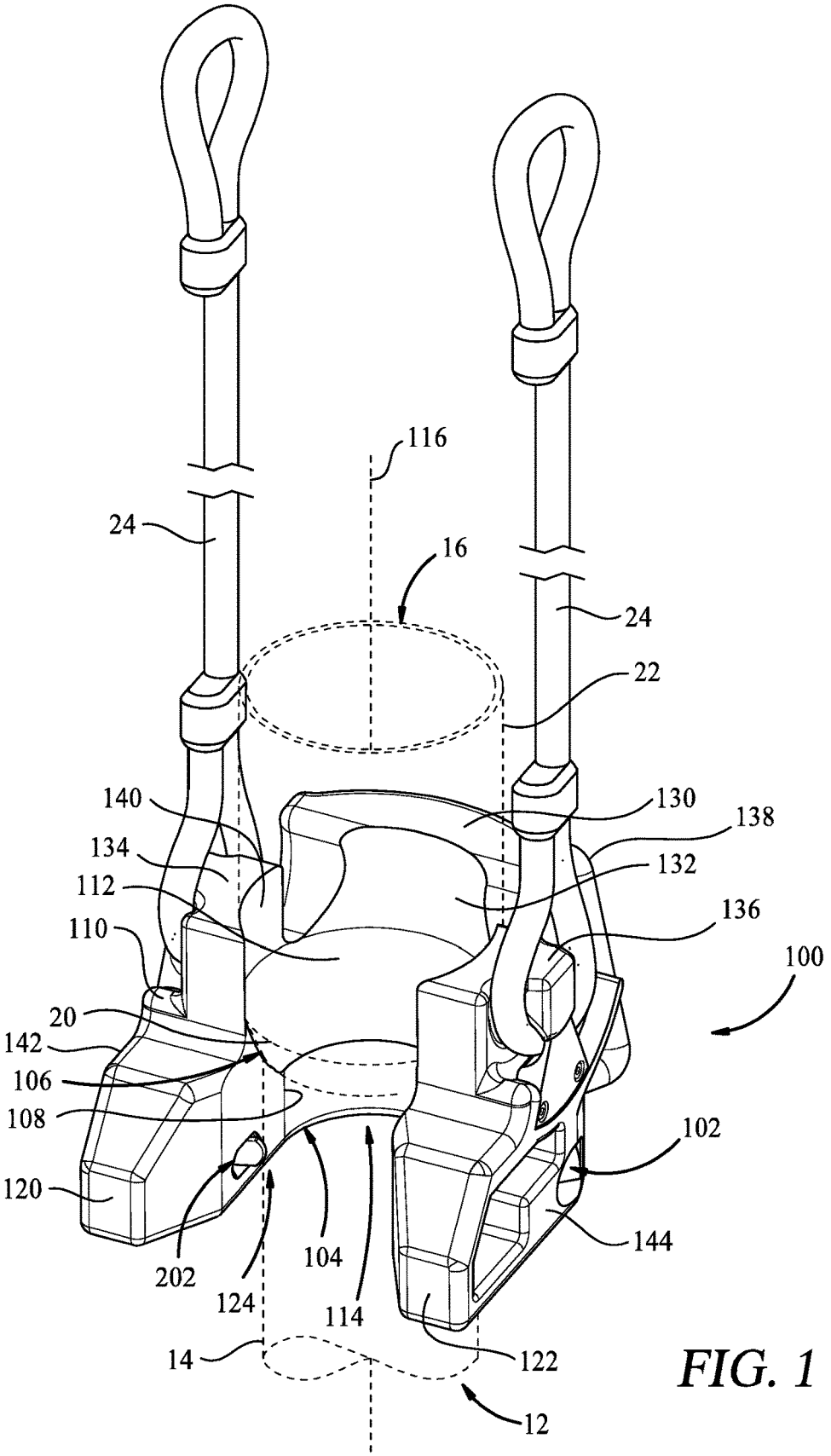
FIG. 1 is a perspective view of an elevator with a tubular suspended from the elevator, according to one embodiment.

Referring to FIG. 1, an elevator 100 is shown coupled to a tubular 12 that has a tubular body 14 and a joint section 16. The joint section 16 of the tubular 12 includes a joint load surface 20 and an upper joint section 22. The elevator 100 includes an elevator body 102 in the form of a unitary body. The elevator body 102 may generally be in the form of a "U" shape. The elevator body 102 includes a lower body section 104 and an upper body section 106. The lower body section 104 has a lower body surface 108. The upper body section 106 has an upper body surface 112. The upper body surface 112 and the lower body surface 108 define a central bore 114 extending through the elevator body 102. The central bore 114 includes an upper central bore defined by the upper body surface 112 and a lower central bore defined by the lower body surface 108.

The upper body surface 112 tapers inwardly towards the lower body surface 108. The upper body surface 112 functions as a load surface for the tubular 12, and has an elevator taper angle that corresponds to the joint taper angle of the joint load surface 20. The elevator taper angle may be at an 18 degree angle in one embodiment. In other embodiments, the elevator taper angle may range from 12 degrees to 20 degrees. In other embodiments, the elevator taper angle may be at other angles to correspond with a joint taper angle of the joint load surface 20. The central bore 114 includes a longitudinal axis 116 extending through the center of the central bore 114.

The elevator body 102 further includes a first arm 120 and a second arm 122 defining a throat 124 leading to the central bore 114. The throat 124 is adapted to accept the tubular body 14 as the tubular body 14 moves through the throat 124 to the central bore 114, as described in more detail below. The first arm 120 and the second arm 122 extend outwardly from the central bore 114, and extend from the lower body section 104 and the upper body section 106. The first arm 120 has a first outer side 142 and the second arm 122 has a second outer side 144. The elevator 100 includes a securing apparatus 202 for coupling the elevator 100 to the tubular 12 in a coupled position.

The elevator 100 further includes a guide member 130 attached on the elevator body 102 at a top surface 110 of the elevator body 102. The guide member 130 extends upwardly above the upper body section 106 of the elevator body 102. The guide member 130 has a guide member surface 132 having an arcuate shape at least partially surrounding the central bore 114. The guide member 130 has a guide member surface 132 at least partially surrounding the central bore 114 and tapering inwardly towards the upper body surface 112.

The elevator 100 further includes a first lifting member 134 and a second lifting member 136 attached to the top surface 110 of the elevator body 102. The first lifting member 134 has a first lifting member body and the second lifting member 136 has a second lifting member body attached on opposite sides of the elevator body 102. The guide member 130 is disposed between the first lifting member 134 and the second lifting member 136. The first and second lifting members 134, 136 extend upwardly above the upper body section 106 of the elevator body 102. The first and second lifting members 134, 136 each have a lifting member guide surface 140 disposed adjacent the central bore 114. The first and second lifting members 134, 136 each have a hook section.

A pair of slings 24 is shown coupled to the elevator 100 by the first and second lifting members 134, 136. The slings 24 are used to support the elevator 100 and suspended tubular 12. Each sling 24 has a lower loop that may be connected to one of the hooks of the first and second lifting members 134, 136. The first and second lifting members 134, 136 are adapted to connect to the slings 24 at a connection location disposed above the top surface 110 of the upper body section 106. A manual lifting handle 138 is shown attached to a back portion of the elevator body 102. The manual lifting handle 138 may be used by one or more personnel to maneuver and lift the elevator 100.

Figure 2:
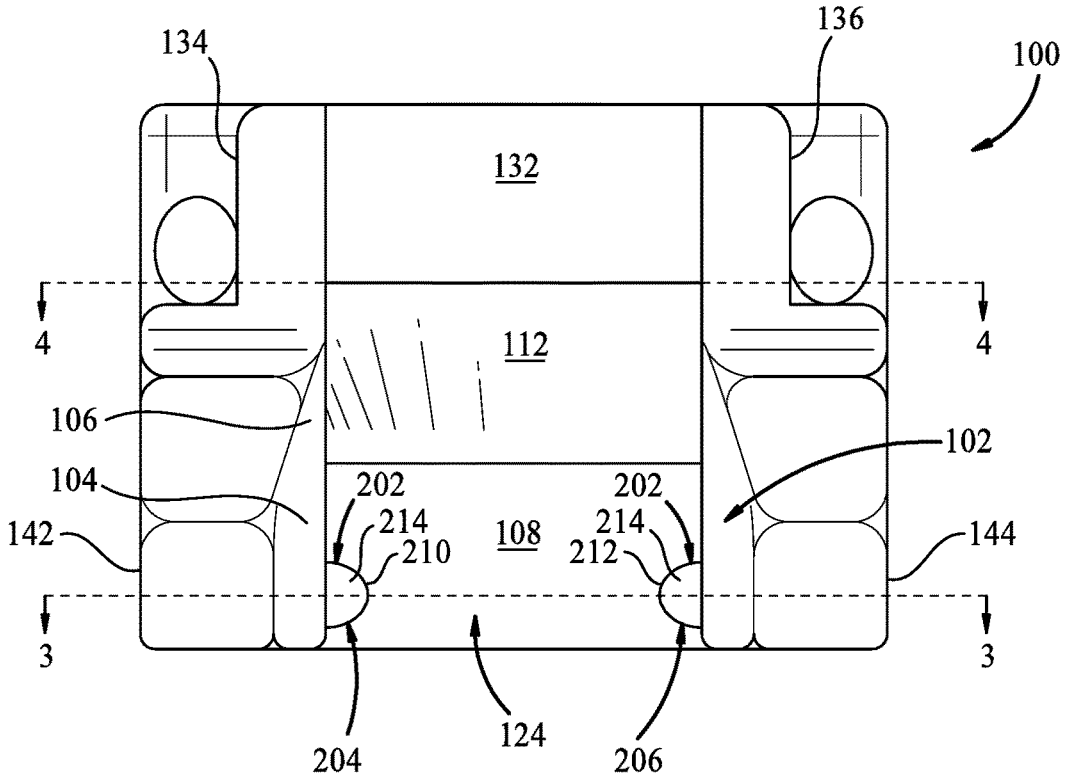
FIG. 2 is a front view of the elevator, according to one embodiment.

FIG. 2 shows a front view of the elevator 100. As shown by FIG. 2, the first and second lifting members 134 and 136 are configured to be disposed within the first outer side 142 of the first arm 120 and the second outer side 144 of the second arm 122. The positioning of the first and second lifting members 134, 136 provides for a reduced width of the elevator 100 so that the elevator 100 may be more easily maneuvered in locations with limited space.

The securing apparatus 202 has a first blocking apparatus 204 and a second blocking apparatus 206 that are disposed in the lower body section 104 and on opposite sides of the lower body section 104. In some embodiments, the securing apparatus 202 may include only one blocking apparatus. The first and second blocking apparatus 204, 206 are biased to extend into the throat 124 in a blocking position where the throat 124 is blocked. The first blocking apparatus 204 includes a first blocking member 210 and the second blocking apparatus 206 includes a second blocking member 212 with both disposed adjacent the lower body surface 108 and extending into the throat 124 when in the blocking position. The first and second blocking members 210, 212 each include a contact surface 214. The throat 124 is blocked by the first and second blocking members 210, 212 when the first and second blocking apparatus 204, 206 are in the blocking position. The first and second blocking members 210, 212 when in the blocking position extend in front of the lower body surface 108 and below the upper body surface 112 of the elevator 100. The guide member surface 132 is shown in FIG. 2 disposed above the upper body surface 112.

Figure 3:
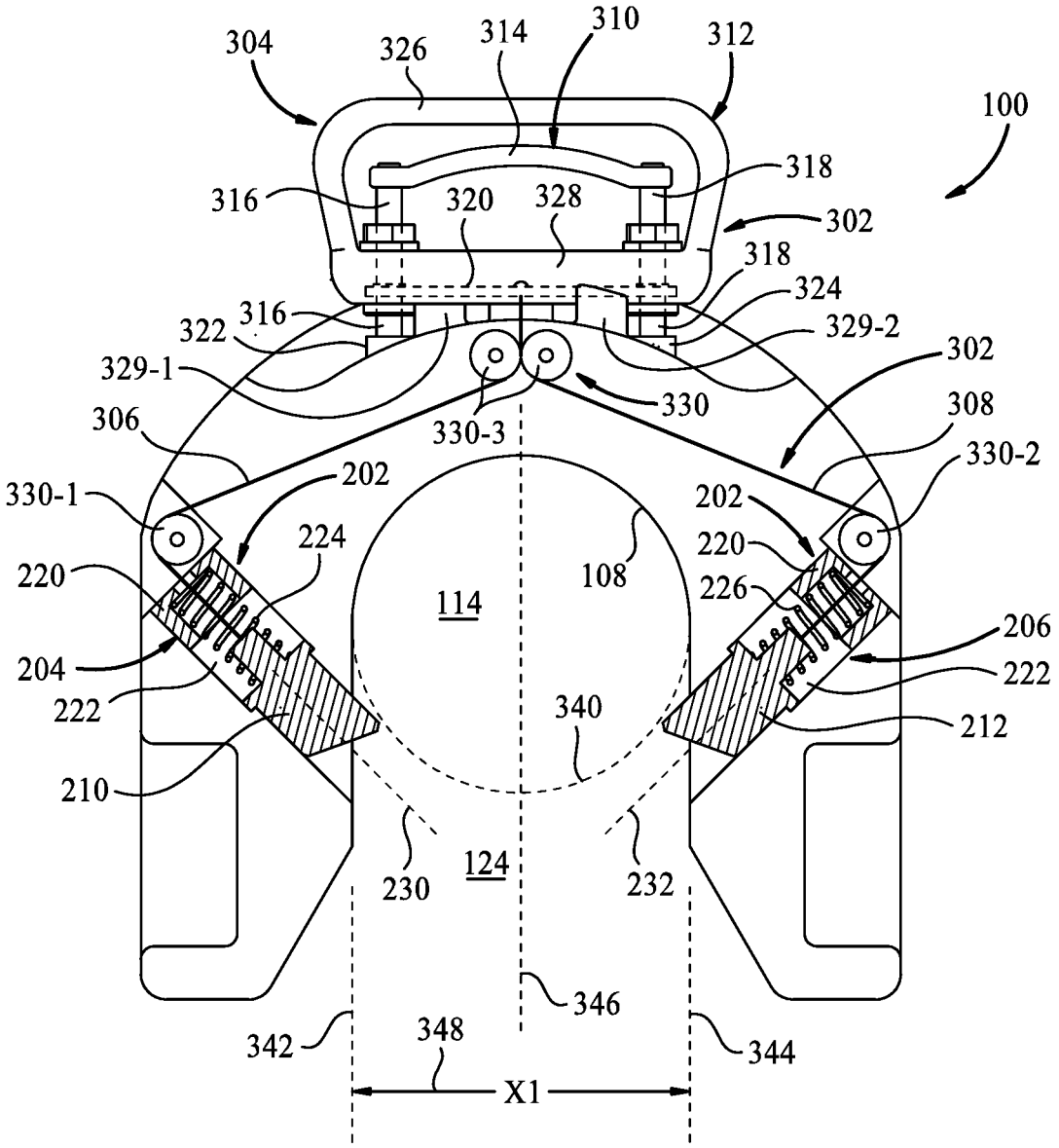
FIG. 3 is a cross-sectional view of the elevator taken along the section lines 3-3 of FIG. 2, illustrating a securing apparatus and an actuation apparatus together used for coupling and decoupling the elevator and the tubular.

FIG. 3 is a cross-sectional view of the elevator 100 taken along the section lines 3-3 of FIG. 2 with the securing apparatus 202 and an actuation apparatus 302 schematically shown. The securing apparatus 202 and the actuation apparatus 302 together are used for coupling and decoupling the elevator 100 and the tubular 12. The actuation apparatus 302 includes an actuation handle apparatus 304 coupled to both the first and second blocking apparatus 204, 206 via a first line 306 attached between the actuation handle apparatus 304 and the first blocking member 210, and a second line 308 attached between the actuation handle apparatus 304 and the second blocking member 212. The first and second lines 306, 308 may be in the form of a Bowden cable. In other embodiments, the first and second lines 306, 308 may be in the form of a metal or non-metallic wire, cable, or cord.

Figure 5B:
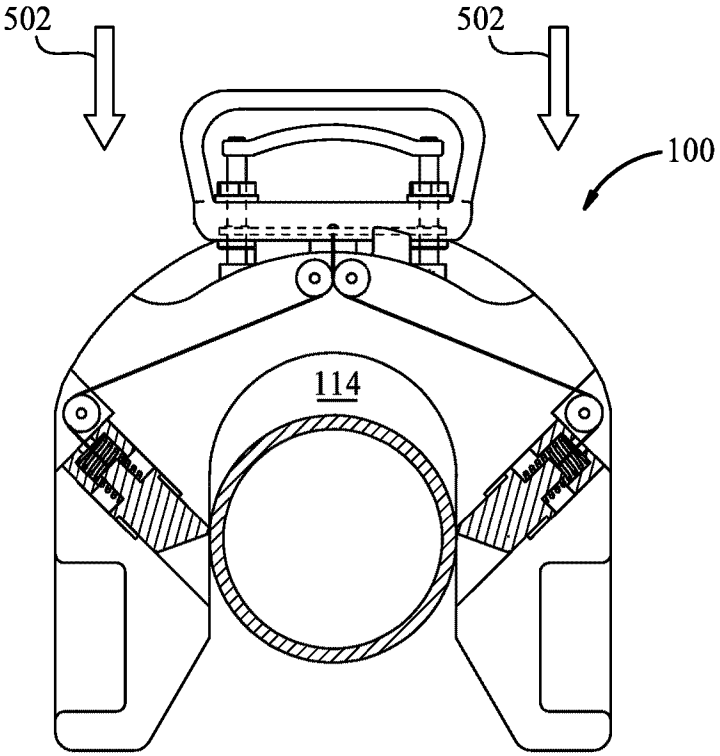
FIGS. 5A-5C is a sequence of cross-sectional views of the elevator taken along the section lines 3-3 of FIG. 2, illustrating the operation of coupling the elevator to the tubular, according to one embodiment.
Figure 5A:
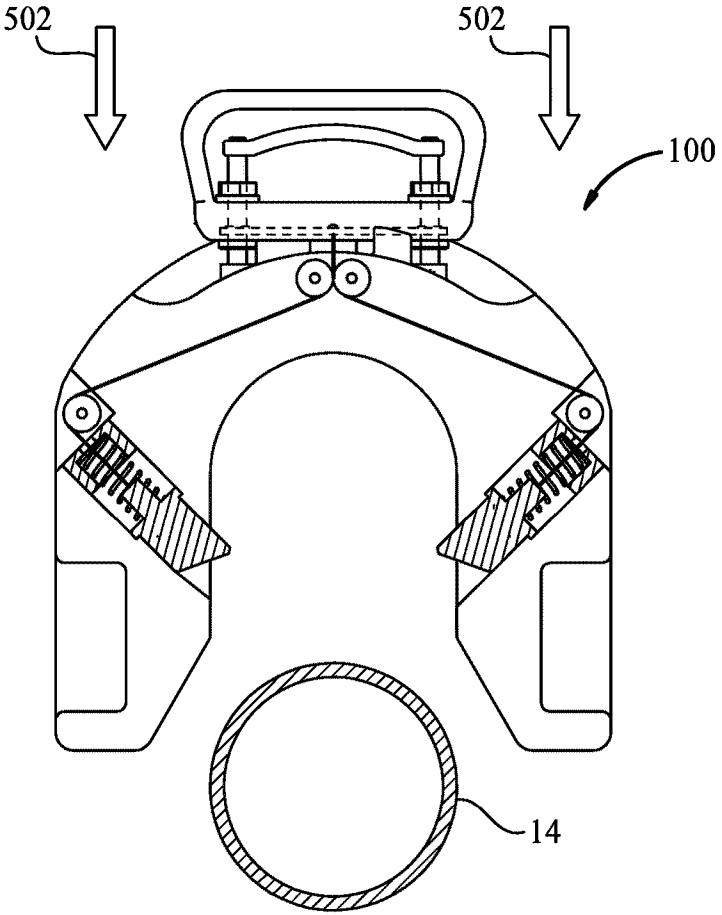
Figure 5D:
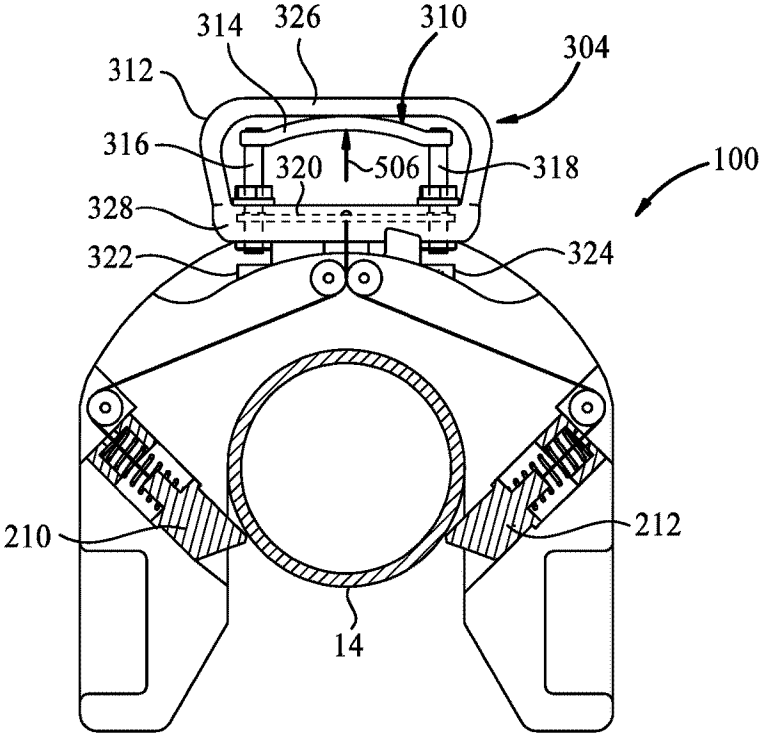
FIGS. 5D-5F is a sequence of cross-sectional views of the elevator taken along the section lines 3-3 of FIG. 2, illustrating the operation of decoupling the elevator to the tubular, according to one embodiment.
Figure 5C:
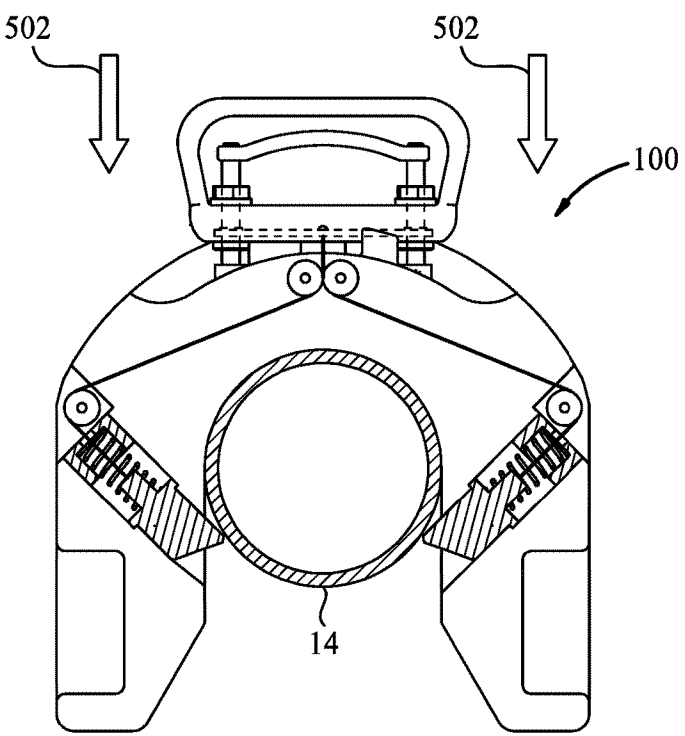
Figure 5F:
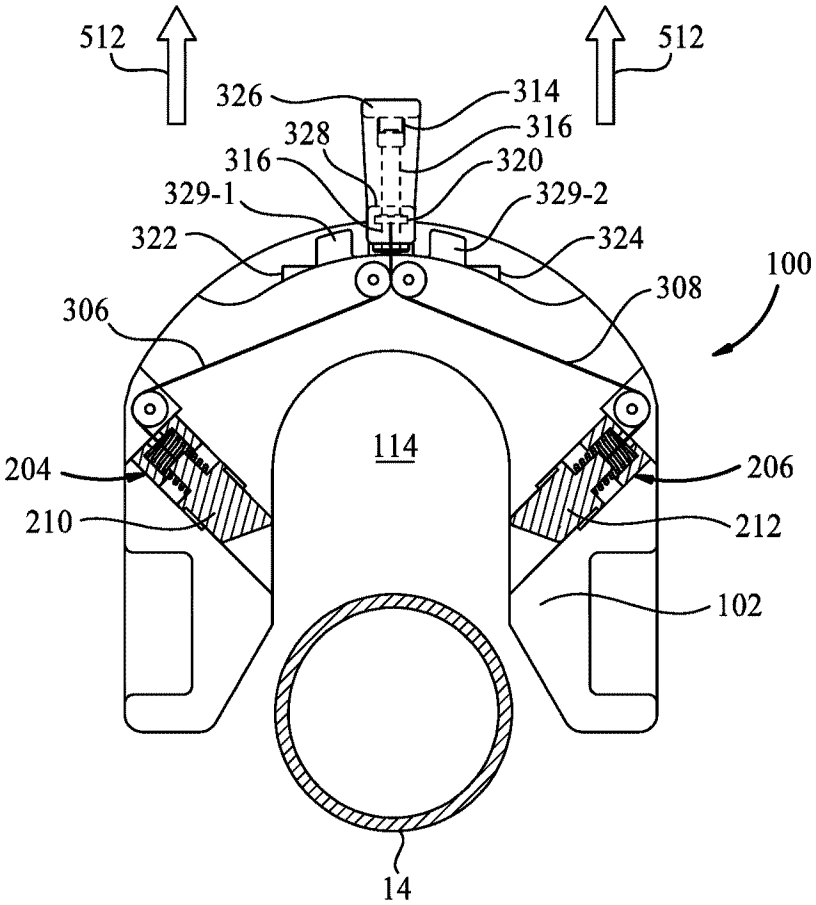
Figure 5E:
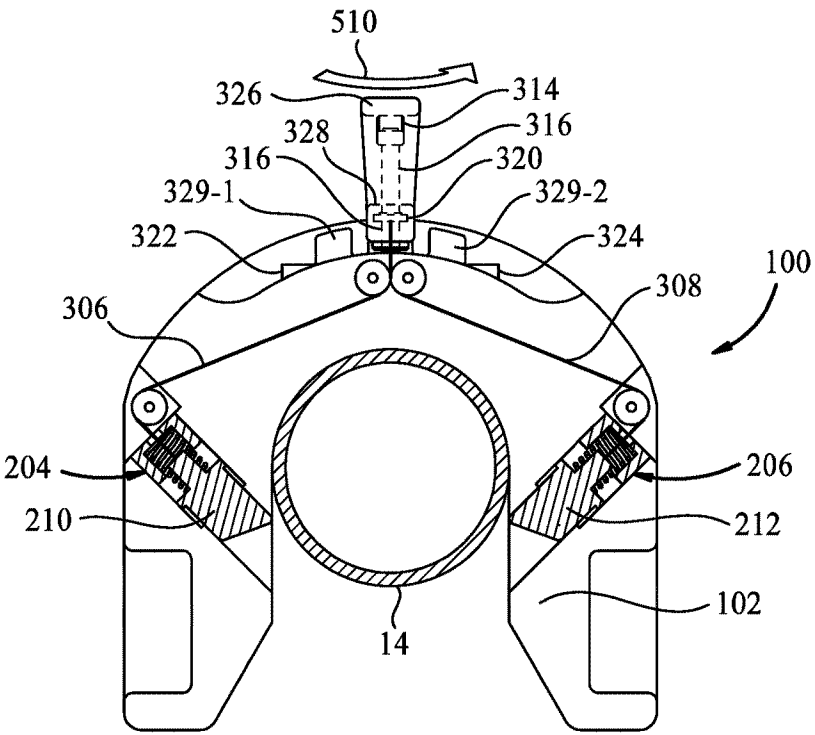

The actuation apparatus 302 is adapted to manually move both the first and second blocking apparatus 204, 206 from the blocking position, as shown in FIGS. 3 and 5D, to a non-blocking position, as shown in FIG. 5E, by moving the actuation handle apparatus 304. The actuation handle apparatus 304 is shown in a first handle position in FIG. 5C, the actuation handle apparatus 304 is shown in a second handle position in FIG. 5D, and the actuation handle apparatus 304 is shown in a third handle position in FIG. 5E. The first line 306 and the second line 308 move in response to the actuation handle apparatus 304 moving from the second handle position to the third handle position. The actuation handle apparatus 304 moves from the second handle position to the third handle position by a person applying a manual force, such as a torque, to the actuation handle apparatus 304 to overcome a biasing force of the first and second blocking apparatus 204, 206. This manual force from the actuation handle apparatus 304 is applied to the first and second blocking members 210, 212 via the first and second lines 306, 308 to position the first and second blocking apparatus 204, 206 from the blocking position to the non-blocking position.

The actuation handle apparatus 304 includes a first handle 310 and a second handle 312. As shown in FIG. 3, the first handle 310 includes a first grip member 314 attached to a first rod 316 and a second rod 318. The second handle 312 is attached to the first blocking apparatus 204 by the first line 306 and the second blocking apparatus 206 by the second line 308. The first and second lines 306, 308 extend through the elevator body 102 and attach to a cross member 320 attached to the second handle 312. The cross member 320 is disposed in the second handle 312. The second handle 312 has a second gripping member 326 and an elongated member 328 spaced from the second gripping member 326, which is attached to the second gripping member 326. A first stop 329-1 and a second stop 329-2 are attached to a back of the elevator body 102 for use when positioning the actuation handle apparatus 304.

The elevator body 102 has a first handle opening 322 and a second handle opening 324 disposed in a back surface of the elevator body 102. The first rod 316 extends into the first handle opening 322 and the second rod 318 extends into the second handle opening 324 when in the first handle position shown in FIG. 3. The first and second rods 316, 318 may be slidably disposed within the first and second handle openings 322, 324.

The first and second blocking apparatus 204, 206 of the securing apparatus 202 each include a cylinder body 220 and a cylinder bore 222. The first and second blocking members 210, 212 are each disposed in one of the cylinder bores 222. Each cylinder body 220 is fixed in a stationary position in the elevator body 102. Each cylinder body 220 may be fixed in the elevator body 102 using bolts, screws, or adhesives. A first blocking member axis 230 extends through the center of the first blocking member 210, and a second blocking member axis 232 extends through the center of the second blocking member 212. The first blocking member 210 moves linearly along the first blocking member axis 230 and the second blocking member 212 moves linearly along the second blocking member axis 232 as the first and second blocking apparatus 204, 206 move between the blocking position and the non-blocking position.

A first biasing member 224 is coupled to the first blocking member 210 and a second biasing member 226 is coupled to the second blocking member 212. The first biasing member 224 is adapted to generate a first biasing force for biasing the first blocking member 210, and the second biasing member 212 is adapted to generate a second biasing force for biasing the second blocking member 212 so as to bias the first and second blocking apparatus 204, 206 in the blocking position. The first blocking apparatus 210 and the second blocking apparatus 212 are adapted to move from the non-blocking position to the blocking position in response to a first biasing force and a second biasing force when the tubular body 14 is moved into the central bore 114 so as to position the elevator 100 and the tubular 12 in a coupled position. The actuation handle apparatus 304 is coupled to the first biasing member 224 and the second biasing member 226 so as to bias the actuation handle apparatus 304 in the first handle position, as shown in FIG. 3.

The first line 306 may attach at a first end to the first blocking member 210 of the first blocking apparatus 204, and the second line 308 may attach at a first end to the second blocking member 212 of the second blocking apparatus 206. The first and second lines 306, 308 may be connected to the first and second blocking members 210, 212 via a bolt, screw, adhesive, or other connection means. The first and second lines 306, 308 each may attach at a second end to the cross member 320 of the second handle 312 via a bolt, screw, adhesive, or other connection means.

In the embodiment shown in FIG. 3, the actuation apparatus 302 further includes an actuation guide apparatus 330 for converting a handle force, such as a rotational force, generated by moving the second handle 312 to a linear force for moving the first and second blocking members 210, 212 in a linear direction along the first blocking member axis 230. The actuation apparatus 302 is adapted to manually move the first and second blocking members 210, 212 from the blocking position to the non-blocking position in unison when moving the actuation handle apparatus 304 from the second handle position to the third handle position. The actuation guide apparatus 330 includes a first guide apparatus 330-1 that may be formed from a first guide post disposed on one side of the elevator body 102, and a second guide apparatus 330-2 that may be formed from a second guide post disposed on an opposite side of the elevator body 102. The actuation guide apparatus 330 further includes a third guide apparatus 330-3 that may be formed from a pair of third guide posts disposed adjacent one another.

The first line 306 extends from the first blocking member 210 and is guided by the first guide apparatus 330-1 and the third guide apparatus 330-3 to the cross member 320 of the second handle 312. The second line 308 extends from the second blocking member 212 and is guided by the second guide apparatus 330-2 and the third guide apparatus 330-3 to the cross member 320 of the second handle 312. The actuation guide apparatus 330 guides the first and second lines 306, 308 so that the handle force is converted to a linear force moving the first and second blocking members 210, 212 in a linear direction along their respective first blocking member axis 230 and second blocking member axis 232.

The first and second blocking apparatus 204, 206 are shown in the blocking position with the first and second blocking members 210, 212 extending into the throat 124. A lower body arc 340 extending from the lower body surface 108 is shown in FIG. 3 by dashed lines. In some embodiments, the lower body arc 340 when extended around the central bore 114 may form a circle with the longitudinal axis 116, shown in FIG. 1, passing through the center of the circle. The tubular body 14 is disposed within the lower body arc 340 when the tubular 12 is coupled to and suspended from the elevator 100. The first and second blocking members 210, 212 extend outwardly of the lower body arc 340 when in the blocking position, as shown in FIG. 3. The lower body surface 108 defining the central bore 114 has an ID (inner diameter) that is approximately equal to the ID of the throat 124, as depicted by a first throat border axis 342 and a second throat border axis 344. The first throat border axis 342 and the second throat border axis 344 are parallel to one another and also to a central axis 346. The central axis 346 is at a right angle to the longitudinal axis 116 of the central bore shown in FIG. 1 and splits the central bore 114 in half.

The diameter of the central bore 114 defined by lower body surface 108 and the throat width between the opposite walls of the first arm 120 and the second arm 122 is depicted by line 348 extending between first throat border axis 342 and the second throat border axis 344. The throat width is depicted by X1 in FIG. 3. The lower body surface 108 is adapted to fit the tubular body 14 in the central bore 114 with the tubular body 14 having an OD that corresponds with the central bore 114. More specifically, the lower body surface 108 is adapted to fit the tubular body 14 within the central bore 114 defined by the lower body section 104. The first and second blocking members 210, 212 extending into the throat 124 are adapted to block the tubular body 14 when disposed in the central bore 114 from moving past the first and second blocking members 210, 212 and into the throat 124. In addition, the first and second blocking apparatus 204, 206 are non-responsive to the tubular body 14 disposed in the central bore 114 applying an outward force against the blocking members 210. The blocking members 210 are adapted to withstand the outward force of the tubular body 14 and remain in the blocking position.

Figure 4:
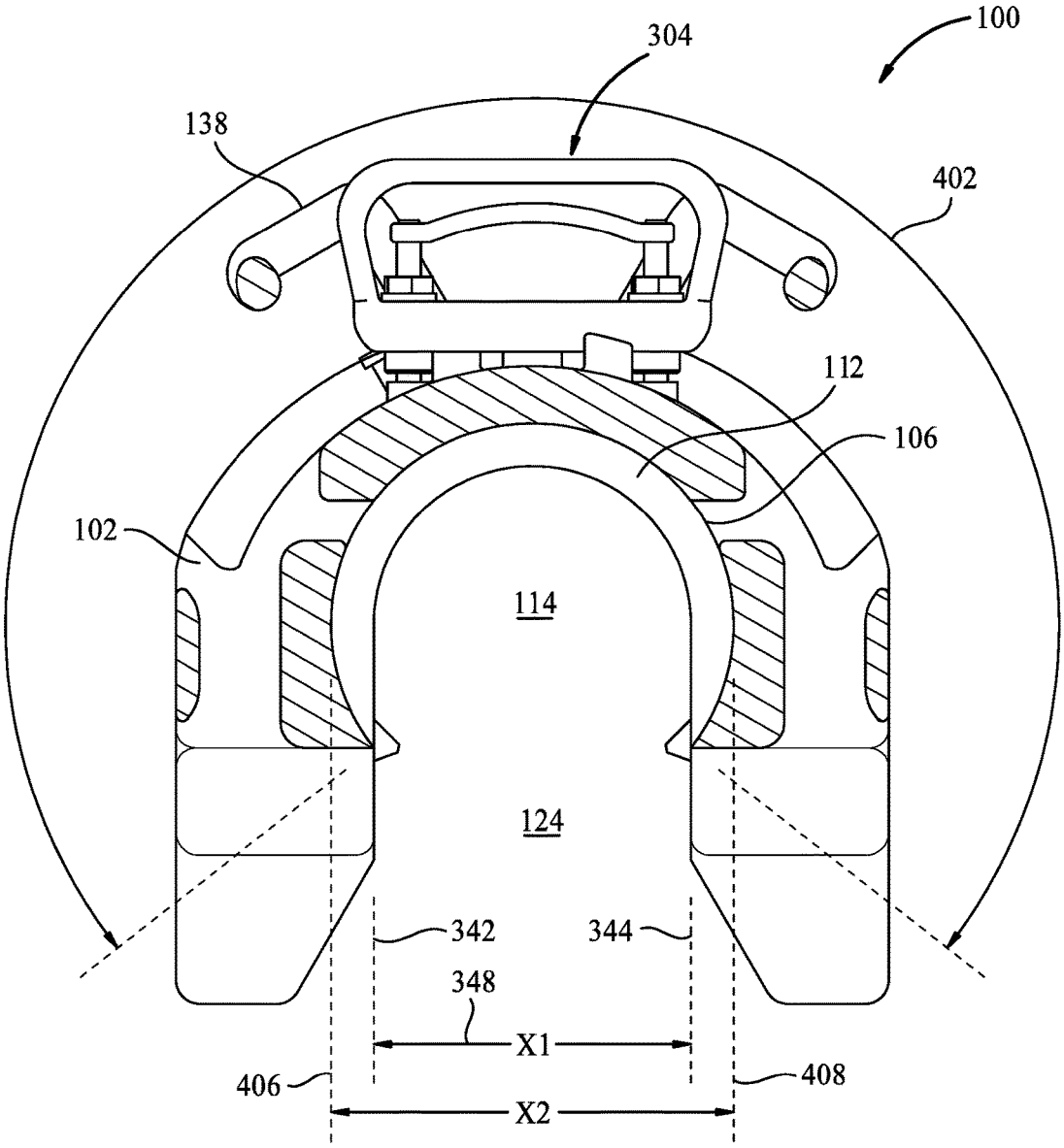
FIG. 4 is a cross-sectional view of the elevator taken along the section lines 4-4 of FIG. 2.

Referring to FIG. 4, a cross-sectional view of the elevator 100 taken along the section lines 4-4 of FIG. 2 is shown. FIG. 4 shows the upper body surface 112 of the elevator 100. The upper body surface 112 is adapted to support the joint section 16 of the tubular 12 and to support the weight of the tubular 12 suspended in the elevator 100, as shown in FIG. 1. The upper body surface 112 partially surrounds the central bore 114 and has a contact arc that is greater than 180 degrees. A contact arc line 402 shown in FIG. 4 depicts the contact arc of the upper body surface 112. In some embodiments, the contact arc may be in the range of 185 degrees to 200 degrees. Because the contact arc of the upper body surface 112 is greater than 180 degrees, the upper body surface 112 is adapted to block the joint section 16 of the tubular 12 disposed in the central bore 114, as shown in FIG. 1, from moving into the throat 124. The throat width of the throat 124 extends between the first and second throat border axis 342, 344, and is depicted as X1 in FIG. 3 and FIG. 4. The elevator body 102 is adapted to have a throat width that is less than the OD of the central bore 114 defined by the upper body surface 112. The OD of the central bore 114 defined by the upper body surface 112 is depicted by X2 extending between the OD axis 406, 408. The elevator 100 is configured to trap the tubular 12 in a suspended position in the elevator 100 by both the upper body surface 112 having a contact arc of greater than 180 degrees and using the securing apparatus 202, as shown in FIG. 1.

Referring to FIGS. 5A-5C, the elevator 100 is shown in a sequence of operations to schematically depict the operation of the securing apparatus 202 used to couple the elevator 100 to the tubular body 14. FIG. 5A shows the elevator 100 and the tubular body 14 in a decoupled position. The elevator 100 is moved towards the tubular body 14, as depicted by arrows 502, and the tubular body 14 begins to enter the throat 124. For example, the manual lifting handle 138, shown in FIG. 1 and FIG. 4, may be used to move the elevator 100. The first and second blocking apparatus 204, 206 are in a blocking position.

In FIG. 5B, the elevator 100 continues to be moved towards the tubular body 14, as depicted by arrows 502. The contact surface 214 of the first and second blocking members 210, 212 engages the tubular body 14 and the biasing force of the first and second blocking apparatus 204, 206 is overcome as the first and second blocking members 210, 212 are forced out of the throat 124 and into the elevator body 102. The securing apparatus 202 is adapted to move from the blocking position, shown in FIG. 5A, to a non-blocking position, shown in FIG. 5B, in response to the tubular body 14 engaging the securing apparatus 202 so as to exert a first force against the securing apparatus 202 as the tubular body 14 moves through the throat 124 to the central bore 114. The blocking members 210 are pressed into the cylinder bore 222 of the cylinder body 220 so that the first and second blocking apparatus 204, 206 are in the non-blocking position. The tubular body 14 is able to move into the central bore 114 when the first and second blocking apparatus 204, 206 are in the non-blocking position. In some embodiments, the actuation handle apparatus 304 remains in a stationary position tubular body 14 moves into the central bore 114.

In FIG. 5C, the tubular body 14 is shown disposed within the central bore 114 with the first and second blocking apparatus 204, 206 back in the blocking position. When the tubular body 14 is disposed in the central bore 114, the contact surface 214 of the first and second blocking members 210, 212 do not engage the tubular body 14. The pressing force applied by the tubular body 14 to the first and second blocking members 210, 212 is released when the tubular body 14 moves past the first and second blocking members 210, 212 and into the central bore 114.

The biasing force of the first and second blocking apparatus 204, 206 force the first and second blocking members 210, 212 to move back to the blocking position extending into and blocking the throat 124. The elevator 100 is in a coupled position with the tubular body 14 trapped in the central bore 114 by the first and second blocking members 210, 212. The elevator 100 may then be raised and moved with respect to the tubular 12 to suspend the tubular 12 from the elevator 100. The first and second blocking apparatus 204, 206 block the tubular 12 from moving through the throat 124 so that the elevator 100 can be raised safely and the tubular 12 suspended.

In FIGS. 5D-5F, the elevator 100 is shown in a sequence of operations for decoupling the elevator 100 from the tubular body 14 using the actuation handle apparatus 304. In the embodiment shown, the elevator 100 has been lowered relative to the tubular 12 so that the tubular body 14 is disposed adjacent the throat 124. As shown in FIG. 5D, the actuation handle apparatus 304 is moved from the first handle position to the second handle position, as depicted by arrow 506. More specifically, a user grips the first grip member 314 of the first handle 310 and moves the first grip member 314 outwardly away from the tubular body 14 and towards the second handle 326, as shown by arrow 506. As the first grip member 314 is moved, the first and second rods 316, 318 are moved out of first and second handle openings 322, 324 and unlock the second handle 326.

The actuation handle apparatus 304 may then be positioned from the second handle position, shown in FIG. 5D, to the third handle position, shown in FIG. 5E. The actuation handle apparatus 304 is positioned from the second handle position to the third handle position by rotating the actuation handle apparatus 304 while in the second handle position, as shown by arrow 510. The third handle position moves the end of the first and second lines 306, 308 coupled thereto outwardly to pull the first and second blocking members 210, 212 from the blocking position to the non-blocking position. The first and second stops 329-1, 329-2 limit the range of rotation of the actuation handle apparatus 304 by blocking the elongated member 328 of the second gripping member 326.

The actuation handle apparatus 304 is adapted to be moved by a user from the second handle position to the third handle position. The actuation handle apparatus 304 is adapted to be in an unfixed position and biased to move back to the first handle position when in the second or third handle positions. When in the third handle position, a user may release the manual force on the actuation handle apparatus 304 such that it moves back into the first handle position due to the first and second biasing forces of the first and second biasing members 224, 226.

After the first and second blocking members 210, 212 are retracted from the throat 124 and positioned in the non-blocking position, the elevator 100 may be moved away from the tubular body 14, as shown by arrows 512 in FIG. 5F. The tubular body 14 is moved from the central bore 114 and through the throat 124. FIG. 5F shows the elevator 100 in a decoupled position with the actuation handle apparatus 304 in the third position. The actuation handle apparatus 304 may be positioned by the first and second biasing forces back to the position shown in FIG. 5A. Specifically, the biasing force of the first and second blocking apparatus 204, 206 moves the first grip member 314, the second handle 312, the attached first and second lines 306, 308, and the attached first and second blocking members 210, 212 so as to position the actuation handle apparatus 304 in the first handle position. The actuation handle apparatus 304 is adapted so that a user may grip the actuation handle apparatus 304 with a single hand to position the actuation handle apparatus 304 between the different handle positions. The single-handed positioning of the actuation handle apparatus 304 allows the user to efficiently decouple the elevator 100 from the tubular body 14.

Figure 6A:
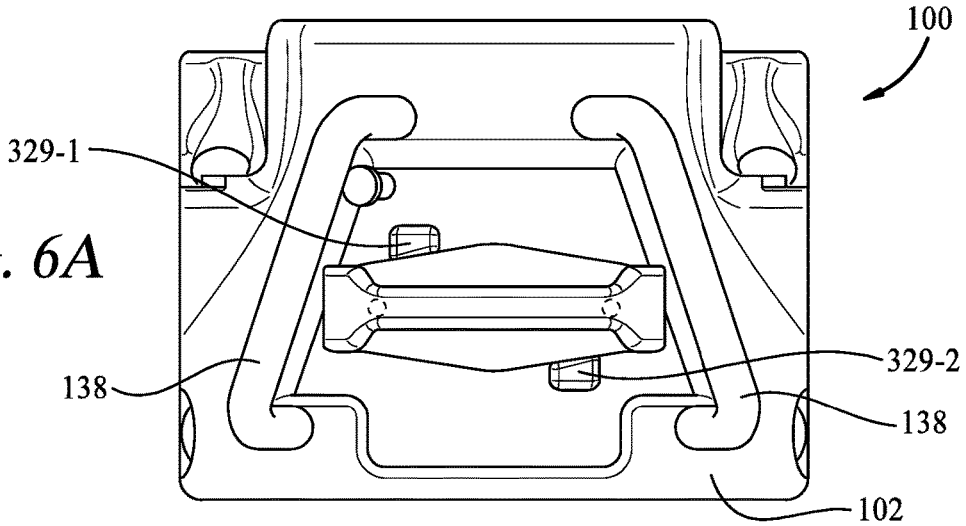
FIGS. 6A-6C is a sequence of back views of the elevator, illustrating an actuation handle apparatus in different positions, according to one embodiment.
Figure 6B:
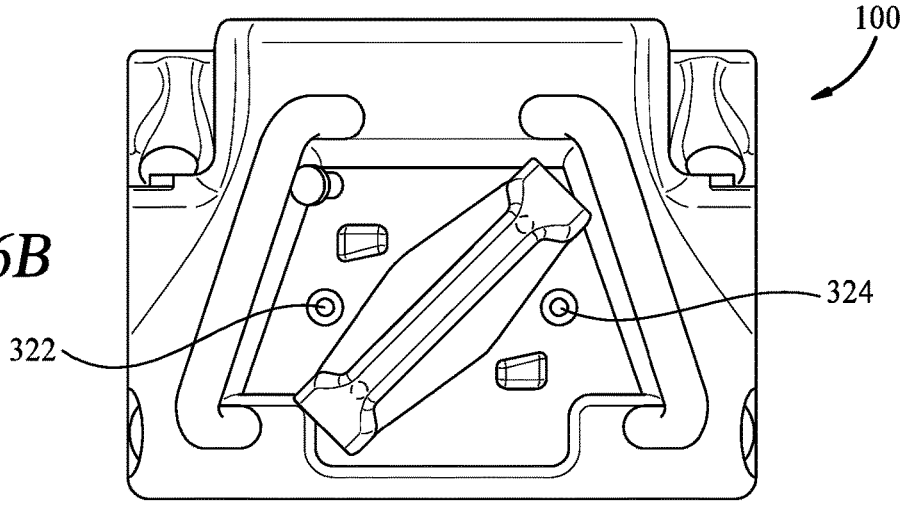
Figure 6C:
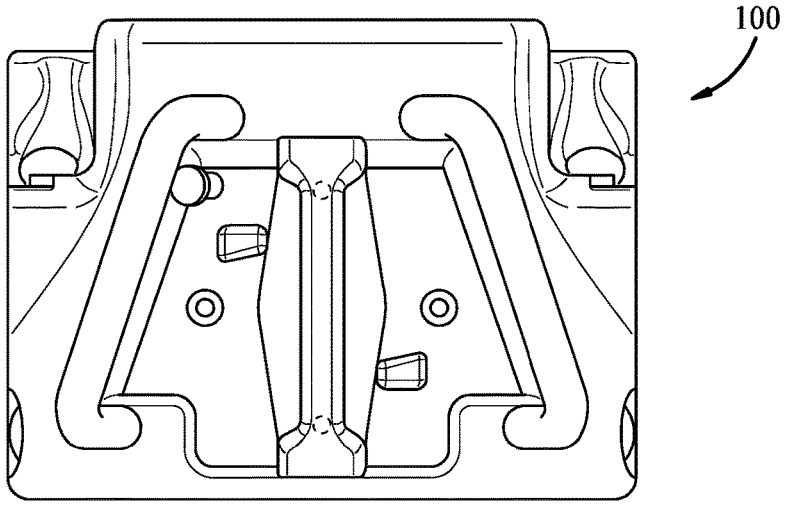

Referring to FIGS. 6A-6C, the elevator 100 is shown from a back view in a sequence of operations for decoupling the elevator 100 from the tubular body 14 using the actuation handle apparatus 304. In FIG. 6A, the actuation handle apparatus 304 is shown in the first handle position. In FIG. 6B, the actuation handle apparatus 304 is shown being rotated from the second handle position towards the third handle position. The first and second handle openings 322, 324 are shown without the first and second rods 316, 318 of the first handle 310 (shown in FIG. 3) inserted therein. Instead the first and second rods 316, 318 are in the retracted position and the first and second blocking members 210, 212 are in the non-blocking position shown in FIG. 5E. In FIG. 6C, the actuation handle apparatus 304 is shown in the third handle position with the first and second blocking members 210, 212 in the non-blocking position shown in FIG. 5E. The manual lifting handles 138 are shown attached to the elevator body 102 and may be used to move the elevator 100 between the coupled position and the decoupled position.

Figure 7A:
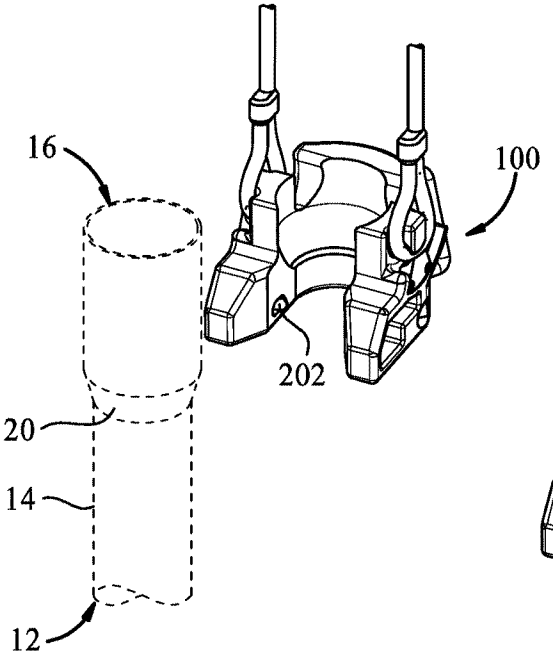
FIGS. 7A-7D is a sequence of perspective views of the elevator, illustrating the operation of coupling the elevator to the tubular, according to one embodiment.
Figure 7B:
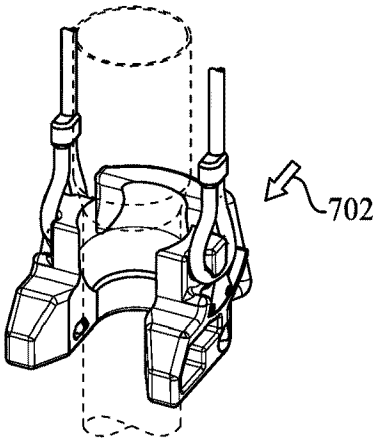
Figure 7C:
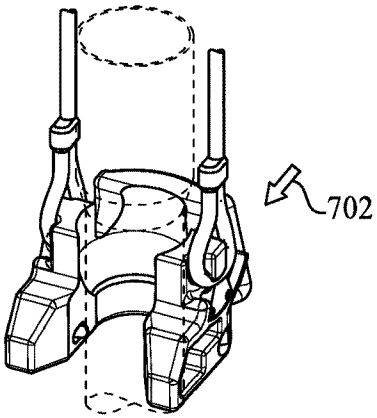
Figure 7D:
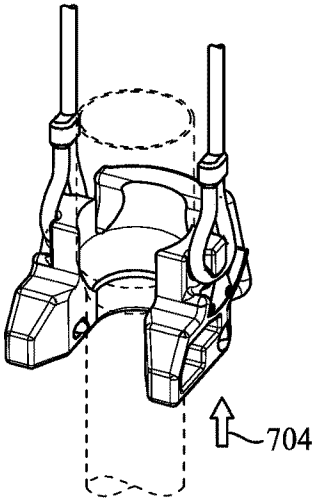

FIGS. 7A-7D is a sequence of perspective views of the elevator 100, illustrating the operation of coupling the elevator 100 to the tubular. In FIG. 7A, the elevator 100 and the tubular 12 are in a decoupled position with the elevator disposed adjacent the tubular body 14. The securing apparatus 202 is in a blocking position, as shown in FIG. 5A. In FIG. 7B, the elevator 100 is moved towards the tubular body 14, as depicted by arrow 702. The tubular body 14 moves through the throat 124 and at least partially into the central bore 114 with the securing apparatus 202 moving to the non-blocking position, as shown in FIG. 5B. In FIG. 7C, the elevator 100 continues to be moved towards the tubular body 14 so that the tubular body 14 is disposed within the central bore 114 and the securing apparatus 202 is positioned in the blocking position, as shown in FIG. 5C. In FIG. 7D, the elevator 100 is moved upwards with respect to the tubular 12, as depicted by arrow 704, so that the tubular 12 is in a suspended position, as disclosed in FIG. 1. With the elevator 100 in the suspended position, the elevator 100 may be moved upwards to position the tubular 12 coupled to the elevator 100 into the suspended position so as to trap the joint section 16 of the tubular 12 in the central bore 114 of the elevator 100. The elevator 100 may then be moved to raise and lower the tubular 12 and position the tubular 12 to a selected location.

Figure 7G:
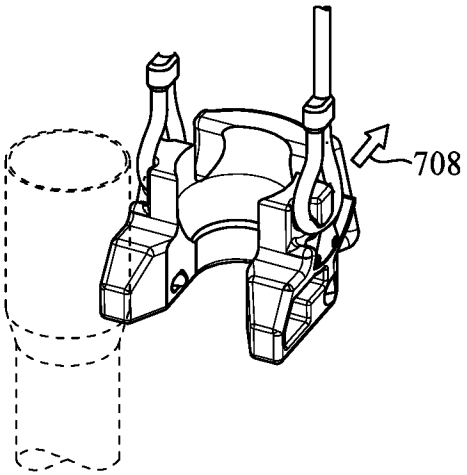
FIGS. 7E-7G is a sequence of perspective views of the elevator, illustrating the operation of decoupling the elevator from the tubular, according to one embodiment.
Figure 7F:
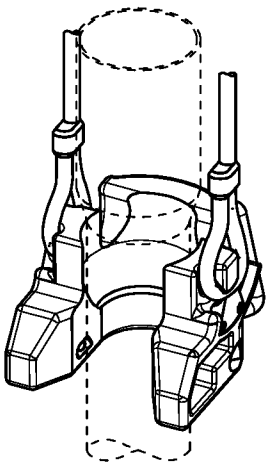
Figure 7E:
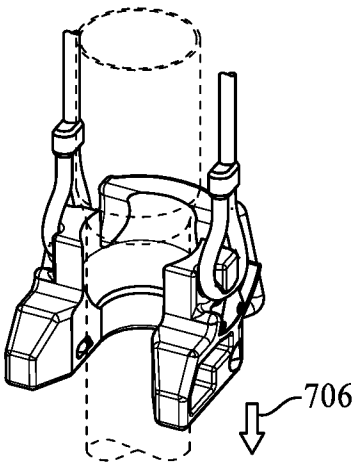

FIGS. 7E-7F is a sequence of perspective views of the elevator 100, illustrating the operation of decoupling the elevator 100 from the tubular 12. In FIG. 7E, the elevator 100 is moved downward with respect to the tubular 12, as depicted by arrow 706. In FIG. 7F, the actuation handle apparatus 304 of the elevator 100 is moved from the first handle position to the second and third handle positions so as to move the securing apparatus 202 to the non-blocking position, as discussed with respect to FIGS. 5D-5E. In FIG. 7G, the elevator 100 is moved away from the tubular 12, as depicted by arrow 708 and discussed with respect to FIG. 5F.

The elevator 100 as described herein has a compact footprint and is lightweight so that the elevator 100 can be easily coupled and decoupled from a tubular. The compact footprint also allows the elevator 100 to access a tubular that is stored where there is limited space for the elevator 100 to pick-up or laydown the tubular. The elevator 100 is lightweight and adapted to be easily manually rotatable to allow for a person to assist in the positioning of the elevator 100 for coupling and decoupling the tubular to the elevator 100.

While the foregoing is directed to embodiments of the disclosure, other and further embodiments of the disclosure may be devised without departing from the basic scope thereof, and the scope thereof is determined by the claims that follow.

The invention claimed is:

1. An elevator for moving a tubular having a tubular body and a joint section, the elevator comprising:

an elevator body comprising:

a lower body section having a lower body surface;

an upper body section having an upper body surface, wherein the upper body surface and the lower body surface define a central bore extending through the elevator body; and a first arm and a second arm defining a throat leading to the central bore and adapted to accept the tubular body as the tubular body moves into the central bore through the throat;

a securing apparatus having a first blocking apparatus and a second blocking apparatus biased in a blocking position where the throat is blocked, wherein the first blocking apparatus and the second blocking apparatus are adapted to move from the blocking position to a non-blocking position in response to the tubular body engaging the securing apparatus so as to exert a force against the securing apparatus as the tubular body moves through the throat to the central bore; and an actuation handle apparatus coupled to the first blocking apparatus and the second blocking apparatus and adapted to manually move both the first blocking apparatus and the second blocking apparatus from the blocking position to the non-blocking position by moving the actuation handle apparatus with a manual force from a first handle position to a second handle position and a third handle position, wherein the actuation handle apparatus moves from the first handle position to the second handle position in response to gripping and moving a first handle of the actuation handle apparatus outwardly along a linear axis toward a second handle of the actuation handle apparatus, and the actuation handle apparatus moves from the second handle position to the third handle position in response to rotating the first handle and the second handle about the linear axis.

2. The elevator of claim 1, wherein the first blocking apparatus and the second blocking apparatus are adapted to move from the non-blocking position to the blocking position in response to a first biasing force and a second biasing force when the tubular body is moved into the central bore so as to position the elevator and the tubular in a coupled position.

3. The elevator of claim 2, wherein the first blocking apparatus has a first blocking member and the second blocking apparatus has a second blocking member, and wherein the first blocking member and the second blocking member are adapted to block the tubular body from passing through the throat when the first blocking apparatus and the second blocking apparatus are in the blocking position.

4. The elevator of claim 3, wherein the first blocking apparatus has a first biasing member adapted to generate the first biasing force and the second blocking apparatus has a second biasing member adapted to generate the second biasing force, and wherein the first blocking member is disposed in a first bore and moves linearly along a first blocking member axis that extends through a center of the first blocking member as the first blocking apparatus moves between the blocking position and the non-blocking position, and the second blocking member is disposed in a second bore and moves linearly along a second blocking member axis that extends through a center of the second blocking member as the second blocking apparatus moves between the blocking position and the non-blocking position.

5. The elevator of claim 4, wherein when the actuation handle apparatus is in the third handle position, a user may release the manual force so that the actuation handle apparatus is moved back into the first handle position due to the first and second biasing forces.

6. The elevator of claim 5, wherein the actuation handle apparatus further comprises a first line attached between the actuation handle apparatus and the first blocking member and a second line attached between the actuation handle apparatus and the second blocking member, and wherein the first line and the second line move in response to the actuation handle apparatus moving from the second handle position to the third handle position so as to overcome the first biasing force of the first biasing member and the second biasing force of the second biasing member to position the first blocking apparatus and the second blocking apparatus from the blocking position to the non-blocking position.

7. The elevator of claim 4, wherein the rotating of the second handle moves the first blocking member and the second blocking member from the blocking position to the non-blocking position in unison.

8. The elevator of claim 4, wherein the actuation handle apparatus is coupled to the first biasing member and the second biasing member so as to bias the actuation handle apparatus in the first handle position.

9. The elevator of claim 3, wherein the force exerted against the securing apparatus by the tubular body is released as the tubular body moves past the first blocking member and the second blocking member and into the central bore.

10. The elevator of claim 1, wherein the upper body surface has a contact arc greater than 180 degrees to support the joint section of the tubular when the elevator is coupled to the tubular with the tubular in a suspended position so as to trap the joint section of the tubular in the elevator.

11. The elevator of claim 10, further comprising a guide member attached on the elevator body extending upwardly above the upper body section of the elevator body, wherein the guide member has a guide member surface at least partially surrounding the central bore and tapering inwardly towards the upper body surface.

12. The elevator of claim 11, further comprising a first lifting member and a second lifting member attached on opposite sides of the elevator body with the guide member disposed between the first lifting member and the second lifting member, wherein the first lifting member and the second lifting member extend upwardly above the upper body section of the elevator body, and wherein the first lifting member and the second lifting member each have a lifting member guide surface disposed adjacent the central bore.

13. An elevator for moving a tubular having a tubular body and a joint section, the elevator comprising:

an elevator body defining a central bore extending through the elevator body, the elevator body comprising a first arm and a second arm defining a throat leading to the central bore and adapted to accept the tubular body as the tubular body moves into the central bore;

a securing apparatus having a first blocking apparatus and a second blocking apparatus, wherein the securing apparatus is adapted to move from a blocking position to a non-blocking position in response to the tubular body engaging the securing apparatus so as to exert a force against the securing apparatus as the tubular body moves through the throat to the central bore, wherein the securing apparatus is adapted to move from the non-blocking position to the blocking position in response to a first biasing force and a second biasing force when the tubular body is moved into the central bore; and an actuation handle apparatus attached to the first blocking apparatus and the second blocking apparatus and adapted to manually move both the first blocking apparatus and the second blocking apparatus from the blocking position to the non-blocking position by moving the actuation handle apparatus with a manual force from a first handle position to a second handle position and a third handle position, wherein the actuation handle apparatus moves from the first handle position to the second handle position in response to gripping and moving a first handle of the actuation handle apparatus outwardly along a linear axis toward a second handle of the actuation handle apparatus, and the actuation handle apparatus moves from the second handle position to the third handle position in response to rotating the first handle and the second handle about the linear axis.

14. The elevator of claim 13, wherein the first blocking apparatus has a first blocking member and the second blocking apparatus has a second blocking member, and wherein the first blocking member and the second blocking member are adapted to block the tubular body from passing through the throat when the first blocking apparatus and the second blocking apparatus are in the blocking position.

15. The elevator of claim 14, wherein the first blocking apparatus has a first biasing member adapted to generate the first biasing force and the second blocking apparatus has a second biasing member adapted to generate the second biasing force, and wherein the first blocking member is disposed in a first bore and moves linearly along a first blocking member axis that extends through a center of the first blocking member as the first blocking apparatus moves between the blocking position and the non-blocking position, and the second blocking member is disposed in a second bore and moves linearly along a second blocking member axis that extends through a center of the second blocking member as the second blocking apparatus moves between the blocking position and the non-blocking position.

16. The elevator of claim 14, wherein the actuation handle apparatus further comprises a first line attached between the actuation handle apparatus and the first blocking member and a second line attached between the actuation handle apparatus and the second blocking member, and wherein the first line and the second line move in response to the actuation handle apparatus moving from the second handle position to the third handle position so as to overcome the first biasing force and the second biasing force and move the first blocking member and the second blocking member to position the first blocking apparatus and the second blocking apparatus from the blocking position to the non-blocking position.

17. The elevator of claim 14, wherein the rotating of the second handle moves the first blocking member and the second blocking member from the blocking position to the non-blocking position in unison.

18. The elevator of claim 14, wherein the force exerted against the securing apparatus by the tubular body is released as the tubular body moves past the first blocking member and the second blocking member and into the central bore.

19. A method of moving a tubular having a tubular body and a joint section with an elevator, comprising:

positioning the elevator adjacent the tubular body, wherein the elevator comprises:

a lower body section having a lower body surface;

an upper body section having an upper body surface, wherein the upper body surface and the lower body surface define a central bore extending through the elevator;

a first arm and a second arm defining a throat leading to the central bore and adapted to accept the tubular body as the tubular body moves to the central bore through the throat;

a securing apparatus biased in a blocking position by a biasing force for securing the tubular in the elevator in a coupled position, wherein the securing apparatus is adapted to move from the blocking position to the non-blocking position in response to the tubular body engaging the securing apparatus so as to exert a force against the securing apparatus as the tubular body moves through the throat to the central bore; and an actuation handle apparatus attached to the securing apparatus and adapted to manually move the securing apparatus from the blocking position to the non-blocking position by moving the actuation handle apparatus with a manual force from a first handle position to a second handle position and a third handle position, wherein the actuation handle apparatus moves from the first handle position to the second handle position in response to gripping and moving a first handle of the actuation handle apparatus outwardly along a linear axis toward a second handle of the actuation handle apparatus, and the actuation handle apparatus moves from the second handle position to the third handle position in response to rotating the first handle and the second handle about the linear axis;

coupling the elevator to the tubular body by moving the elevator and the tubular into the coupled position; and moving the elevator to position the tubular in the coupled position into a suspended position, wherein the upper body surface has a contact arc greater than 180 degrees to support the joint section of the tubular when the elevator is coupled to the tubular with the tubular in the suspended position so as to trap the joint section of the tubular in the elevator.

20. The method of claim 19, wherein the securing apparatus comprises a first blocking apparatus having a first blocking member and a second blocking apparatus having a second blocking member, and the force exerted against the securing apparatus by the tubular body is released as the tubular body moves past the first blocking member and the second blocking member and into the central bore.

21. The method of claim 20, wherein the first blocking member is disposed in a first bore and moves linearly along a first blocking member axis that extends through a center of the first blocking member as the first blocking apparatus moves between the blocking position and the non-blocking position, and the second blocking member is disposed in a second bore and moves linearly along a second blocking member axis that extends through a center of the second blocking member as the second blocking apparatus moves between the blocking position and the non-blocking position.

* * * * *